US005570664A

United States Patent [19]

Nohara

[11] Patent Number: 5,570,664

[45] Date of Patent: Nov. 5, 1996

[54] ENGINE VALVE DRIVE DEVICE

[75] Inventor: Tsuneyasu Nohara, Ebina, Japan

[73] Assignee: Nissan Motor Co., Ltd., Kanagawa, Japan

[21] Appl. No.: 522,437

[22] Filed: Aug. 31, 1995

[30] Foreign Application Priority Data

Sep. 2, 1994 [JP] Japan ..... 6-210017

[51] Int. Cl.[6] ..... F01L 13/00

[52] U.S. Cl. ..... 123/90.16; 123/90.36; 123/90.44

[58] Field of Search ..... 123/90.15, 90.16, 123/90.17, 90.22, 90.27, 90.33, 90.36, 90.39, 90.44

[56] References Cited

U.S. PATENT DOCUMENTS 4,791,893 12/1988 Muranaka et al. ..... 123/90.44
5,152,267 10/1992 Komatsu et al. ..... 123/399
5,183,015 2/1993 Morita et al. ..... 123/90.16
5,297,516 3/1994 Hara ..... 123/90.16

FOREIGN PATENT DOCUMENTS 58-211514 12/1983 Japan ..... 123/90.39

*Primary Examiner*—Weilun Lo
*Attorney, Agent, or Firm*—Lowe, Price, LeBlanc & Becker

[57] ABSTRACT

A rocker arm is provided free to pivot on a rocker shaft fixed to an engine. A valve that opens and closes according to the oscillation of this rocker arm, and a cam that causes this rocker arm to oscillate in synchronism with the engine, are also provided. A thrust fin projecting in a radial direction is formed in a one-piece construction with the rocker and is narrower than the rocker arm. A guide groove engaging with the thrust fin is formed on the engine so as to prevent the rocker arm from displacing in the axial direction of the rocker shaft. As the width of the guide groove is small, it can be formed easily and with high precision by cutting a part of the engine with an end mill.

5 Claims, 5 Drawing Sheets

ENGINE VALVE DRIVE DEVICE

FIELD OF THE INVENTION

This invention relates to a device that opens and closes an engine valve.

BACKGROUND OF THE INVENTION

Engine intake and exhaust valves are generally pushed in the closing direction by a spring, and are operated for example when a cam that rotates together with the engine pushes the valve in the reverse direction to the spring via a rocker arm.

The rocker arm is supported by a cylinder head such that it is free to oscillate via a rocker shaft. The cam is fixed on a cam shaft parallel to the rocker shaft. The cam shaft rotates together with the engine, and a rocker arm is made to pivot about the rocker shaft by a rotating cam that slides on the rocker arm.

A cam change-over mechanism that selects a plurality of cams in order to vary a lift amount and valve opening period according to engine running conditions is disclosed for example in U.S. Pat. No. 5,152,267. This mechanism comprises a main rocker arm that slides on a low speed cam and a sub-rocker arm that slides on a high speed cam. The operating characteristics of the valve are changed by linking and unlinking these rocker arms according to the engine running conditions.

In this cam change-over mechanism, the valve is always pushed by the main rocker arm, and the main rocker arm, when not engaged with the sub-rocker arm, is driven by the low speed cam. In this case the valve is operated according to the characteristics of the low speed cam. When a hydraulic piston housed in the main rocker arm penetrates the sub-rocker arm, the two rocker arms are engaged with each other and the valve is thereby operated according to the characteristics of the high speed cam.

The pressure that drives this hydraulic piston is supplied to the main rocker arm from a hydraulic passage formed in the center of the rocker shaft. Therefore, when the main rocker arm is displaced in the axial direction of the rocker shaft, an off port formed in the main rocker arm and another port in the rocker shaft are displaced relative to each other so that the flow of oil between the main rocker arm and rocker shaft is obstructed.

It is therefore necessary to restrict the displacement of the main rocker arm in the axial direction. This may be achieved for example by forming a hollow of effectively the same width as the main rocker arm in the cylinder head, installing the rocker shaft in the interior of this hollow, and supporting the main rocker arm by the rocker shaft.

This kind of hollow is generally formed by cutting the cylinder head with an end mill. The wall of the hollow in contact with the rocker arm specifies the position in the axial direction of the rocker arm, so this wall must be a flat vertical, accurately positioned surface.

However, as the wall is finished by pushing the side of the end mill against the wall surface so as to cut it, it is difficult to achieve this kind of precision, and the job is therefore time and labor consuming.

SUMMARY OF THE INVENTION

It is therefore an object of this invention to make it easy to machine a part that limits the axial displacement of a rocker arm.

It is a further object of this invention to reduce frictional resistance to the oscillation of the rocker arm.

It is yet a further object of this invention to improve the swing balance of the rocker arm in a valve drive device provided with a cam change-over mechanism.

In order to achieve the above objects, this invention provides an engine valve drive mechanism comprising a rocker shaft fixed to an engine, a rocker arm having a bearing which is slidably supported on said rocker shaft such that said rocker arm is supported freely to rotate on the rocker shaft, a valve that opens and closes according to an oscillation of the rocker arm, cam means that rotates in synchronism with the engine for causing the rocker arm to oscillate, a thrust fin projecting in from said rocker arm a radial direction with respect to the rocker shaft, a width of said thrust fin being less than a width of said rocker arm, and a guide groove accommodating the thrust fin for preventing the rocker arm from displacing along the rocker shaft.

It is preferable that the cam means comprises a plurality of cams having different profiles, and that the device mechanism further comprises a cam change-over mechanism for changing over the cams.

In this case, it is further preferable that the rocker arm comprises a hydraulic piston for driving the cam change-over mechanism and an off pressure chamber housing this piston, and that the guide groove is situated below the hydraulic piston.

It is also further preferable that the cam change-over mechanism is installed on the rocker arm, and a center of mass of the cam change-over mechanism and a center of mass of the thrust fin are displaced relative to each other along the an axial direction rocker shaft.

The details as well as other features and advantages of this invention are set forth in the remainder of the specification and are shown in the accompanying drawings.

DETAILED DESCRIPTION OF THE PREFERRED EMBODIMENTS

Figure 1:
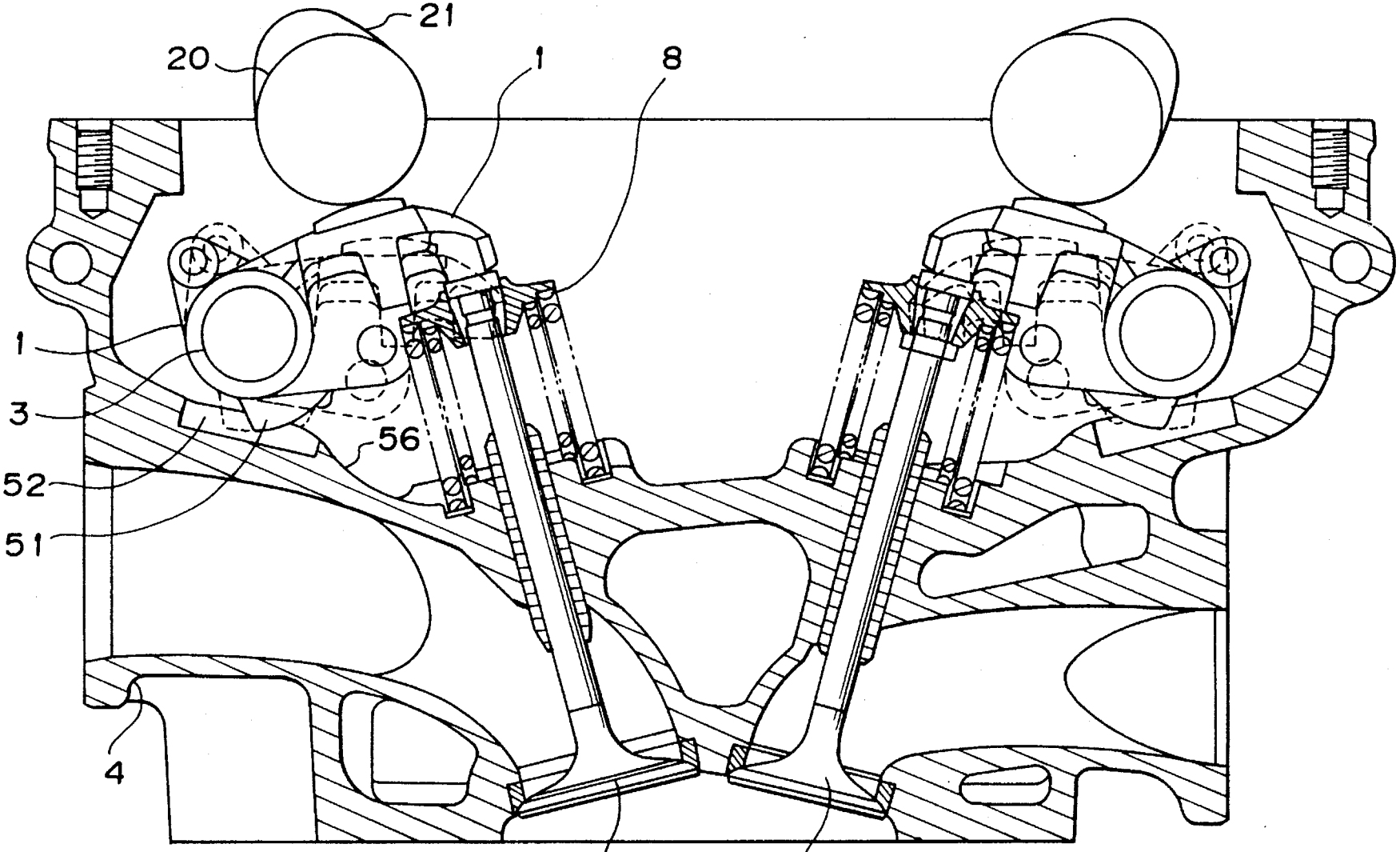
FIG. 1 is a vertical sectional view of a cylinder head according to this invention.

Referring to FIG. 1 of the drawings, an engine is provided with a plurality of cylinders, each cylinder being provided with two intake valves 9 and two exhaust valves 10. The two intake valves 9 operate in synchronism via a common main rocker arm 1.

The base end of the main rocker arm 1 is supported free to pivot on a cylinder head 4 via a rocker shaft 3 common to all the cylinders. The tip of the main rocker arm 1 is in contact with the stem of each of the intake valves 9. As the main rocker arm 1 swings, these stems are pressed down against valve springs 8 so as to open the intake valves 9.

Figure 4:
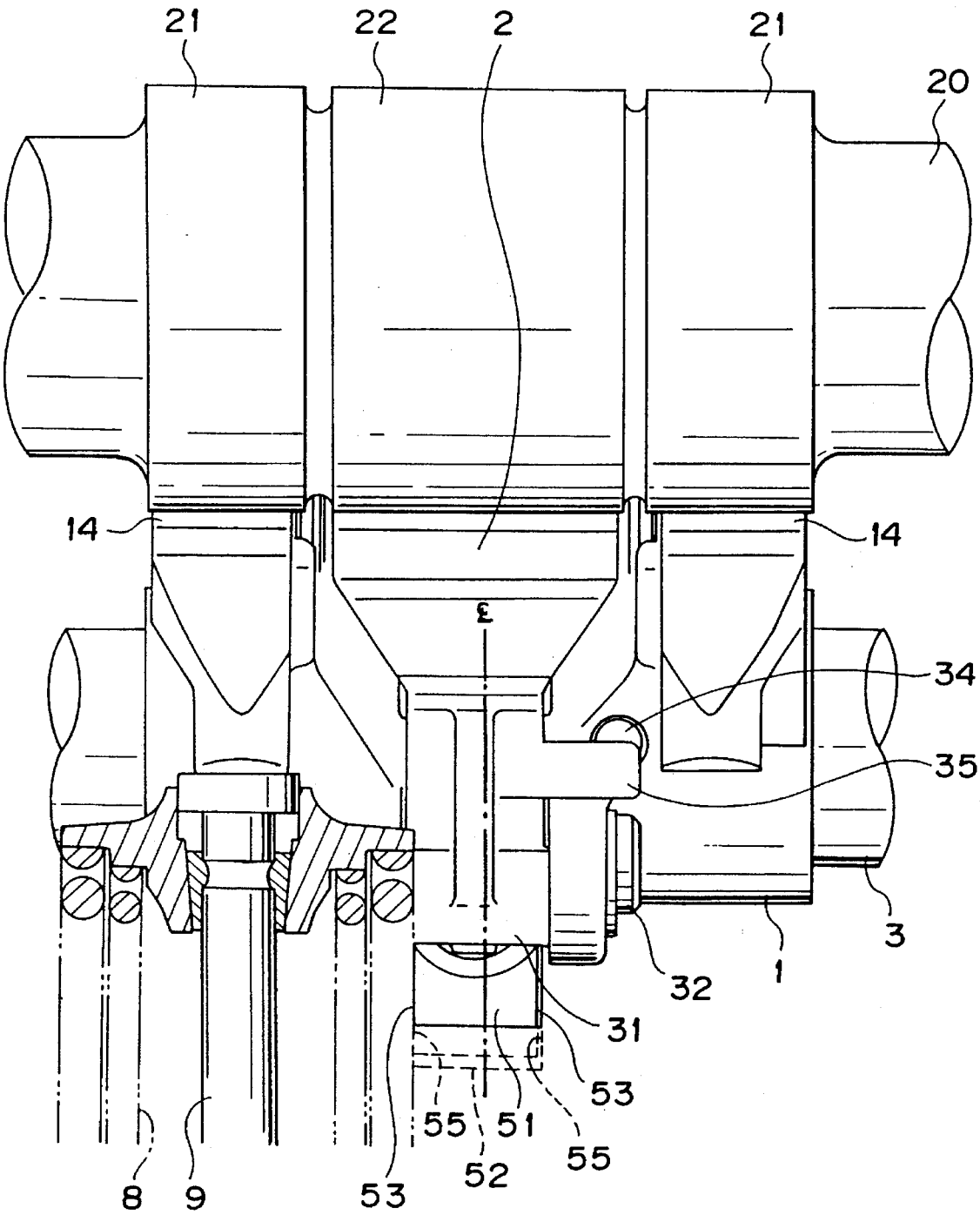
FIG. 4 is a front view of the valve drive device.

A pair of low speed cams 21 and a high speed cam 22 located between the low speed cams 21 are formed in a one-piece construction with the cam shaft 20, as shown in FIG. 4.

These cams have different shapes so that they adapt to different valve lift characteristics required when the engine is running at low speed and when it is running at high speed. The high speed cam 22 provides a larger valve lift and longer opening time compared to the low speed cams 21.

Figure 5:
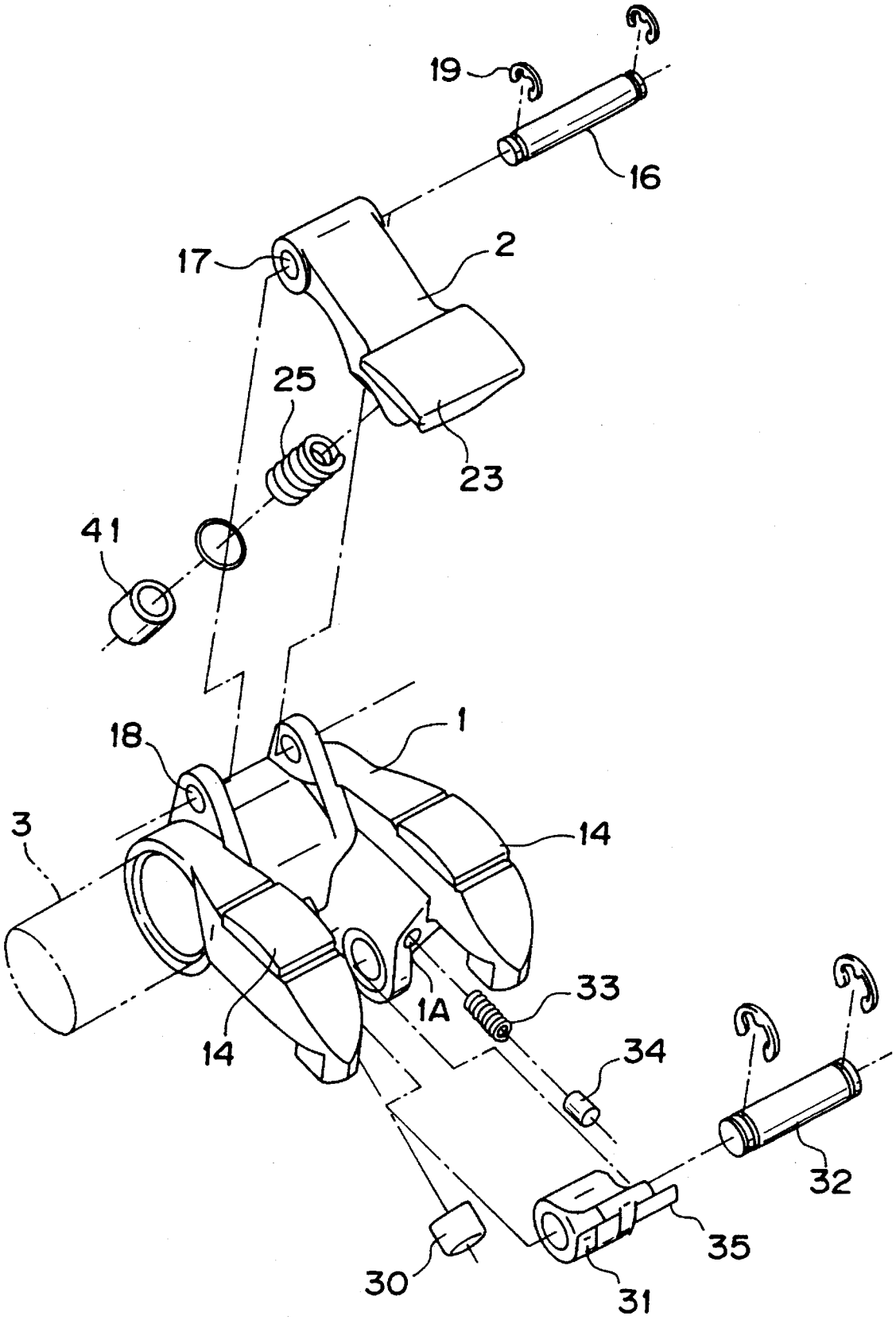
FIG. 5 is a perspective view showing various component parts of the rocker arm.

A pair of cam followers 14 that slide on the pair of low speed cams 21 are provided on the main rocker arm 1, as shown in FIG. 5. A sub-rocker arm 2 is provided between these cam followers 14.

The sub-rocker arm 2 is supported such that it is free to rotate about the main rocker arm 1 via a sub-rocker shaft 16. The sub-rocker shaft 16 passes through a hole 17 formed in the sub-rocker arm 2 and a hole 18 formed in the main rocker arm 1, and ring-clips 19 are fitted on both ends so that the shaft 16 does not fall out of the holes 17 and 18.

A cam follower 23 having an arc-shaped vertical cross section that slides on the high speed cam 22 is provided on the sub-rocker arm 2. The sub-rocker arm 2 has no parts in contact with the intake valves 9.

A lifter 41 is supported on the underside of the sub-rocker arm 2 via a spring 25 so as to cause the sub-rocker arm 2 to pivot as it follows the motion of the high speed cam 22. The opposite side of the lifter 41 is in contact with the main rocker arm 1. When the high speed cam 22 pivots the sub-rocker arm 2 about the main rocker arm I via the cam follower 23, the spring 25 elongates and contracts between the lifter 41 in contact with the main rocker arm 1 and the sub-rocker arm 2.

A cam change-over mechanism is provided between the main rocker arm 1 and sub-rocker arm 2 so as to transmit the oscillation of the sub-rocker arm 2 to the main rocker arm 1.

Figure 2:
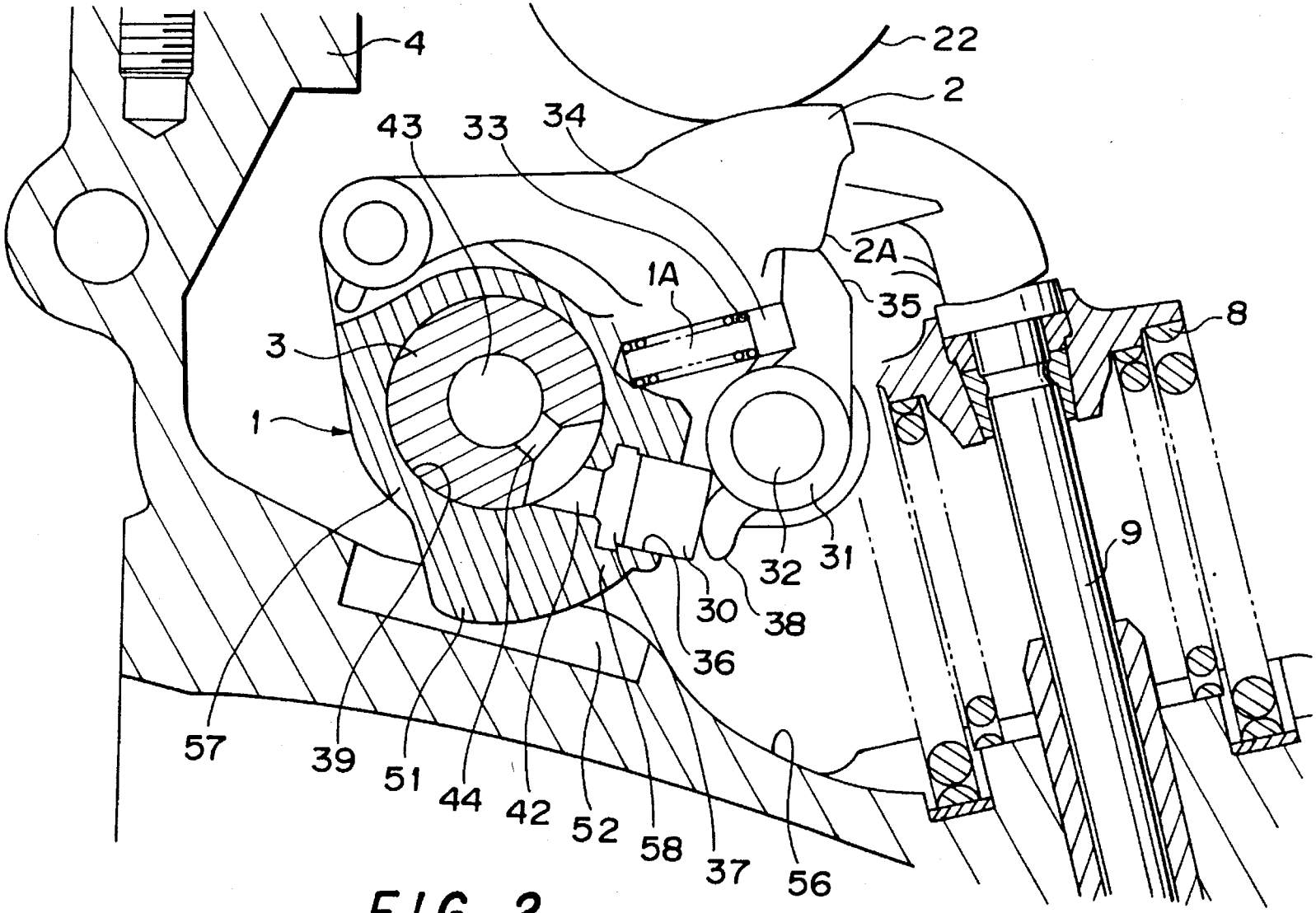
FIG. 2 is a vertical sectional view of a valve drive device according to this invention.
Figure 3:
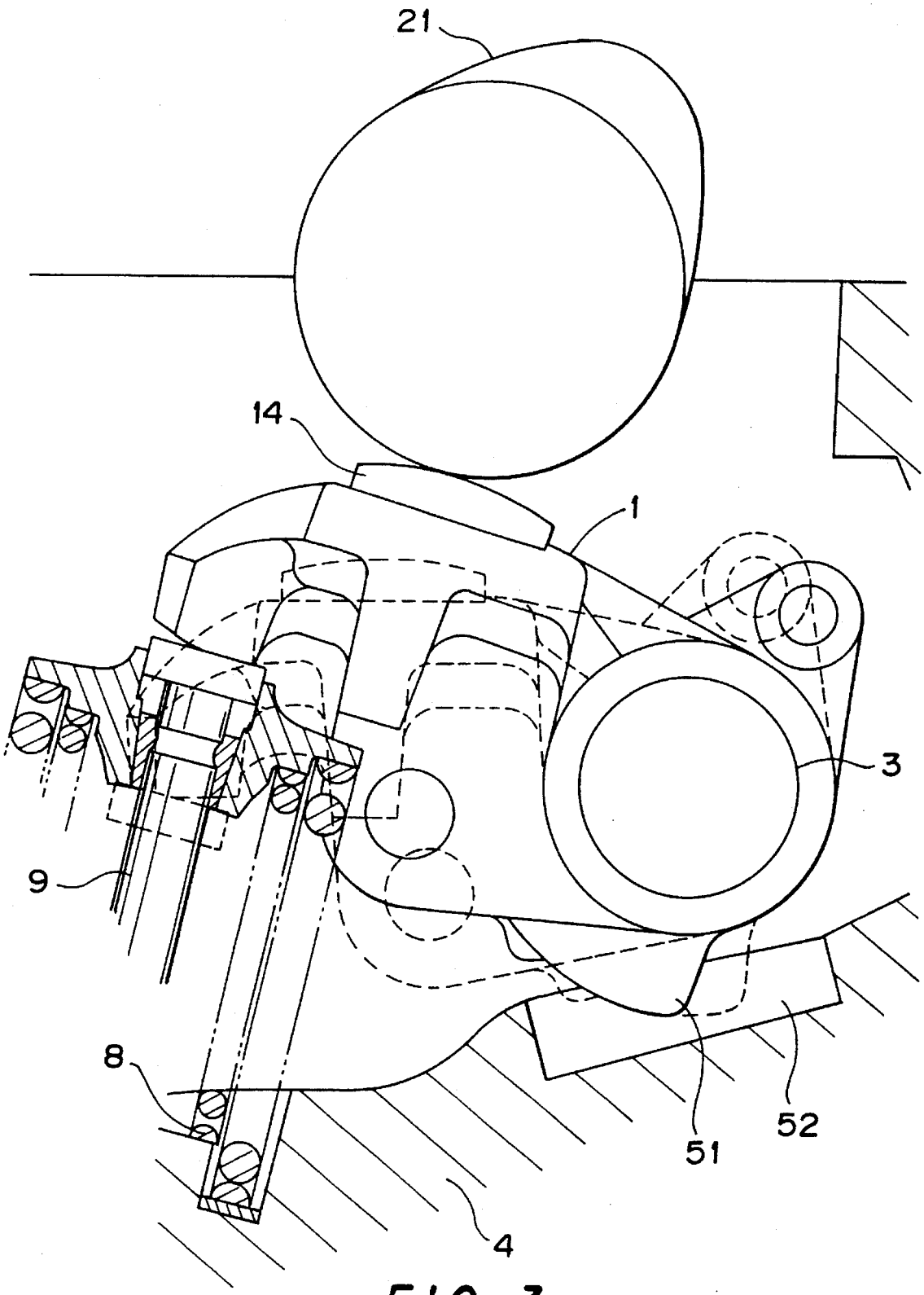
FIG. 3 is a side view of a main rocker arm according to this invention.

This cam change-over mechanism comprises a prop 31 supported to freely pivot on the main rocker arm 1 via a shaft 32. The prop 31 comprises an arm which engages with a chin-shaped tip 2A of the sub-rocker arm 2, as shown in FIG. 2, so as to restrict the rotation of the sub-rocker arm 2 about the main rocker arm 1.

The prop 31 is pushed by a spring 33 in such a direction as to disengage it from the tip 2A. The spring 33 is housed in a hole 1A formed in the main rocker arm 1, and presses the arm 35 via a pin 34.

The spring 33 and pin 34 are installed in positions offset from the center of the sub-rocker arm 2, and the arm 35 has a corresponding shape such that it projects to the side from the prop 31.

A hydraulic piston 30 is housed in the main rocker arm 1 so as to rotate the prop 31 into the position where the arm 35 engages with the tip 2A against the force of the spring 33. The prop 31 has a lever 38 projecting in an opposite direction to that of the arm 35 such that it comes into contact with the piston 30. The piston 30 presses the lever 38 according to the pressure of a hydraulic chamber 37 formed inside the main rocker arm 1 so that the prop 31 rotates against the force of the spring 33.

The pressure of the chamber 37 is led to an oil gallery 43 formed in an axial direction inside the rocker shaft 3 from an oil pump, not shown, via a change-over valve. Further, to lead the pressure of the gallery 43 to the chamber 37 in the main rocker arm 1, a through hole 42 leading respectively into the chamber 37 and into a bearing part 39 supporting the rocker shaft 3 is formed in the main rocker arm 1, as shown in FIG. 2. The rocker shaft 43 has a through hole 44 leading into the gallery 43 in the rocker shaft 3 and into the outer circumference of the rocker shaft 3.

The aforementioned change-over valve opens under predetermined high speed running conditions so as to lead the pressure of the off pump to the gallery 43. This change-over valve is opened and closed by a control unit, not shown, based on an engine speed signal, cooling water temperature signal, lubrication oil temperature signal, supercharging pressure signal from a supercharger, a throttle valve opening signal, etc. In this way, sharp variations of engine torque are suppressed when the low speed cams 21 and high speed cam 22 are changed over.

During low speed engine running conditions, the chamber 37 is at low pressure, and the prop 31 is held in a position where the arm 35 does not engage with the tip 2A. The main rocker arm 1 therefore opens and closes the intake valve 9 according to the profile of the low speed cams 21. The high speed cam 22 also causes the sub-rocker arm 2 to oscillate, however as there is free oscillation between the sub-rocker arm 2 and main rocker arm 1, the action of the main rocker arm 1 is not affected by the sub-rocker arm 2.

During high speed engine rotation, the chamber 37 is at high pressure, the piston 30 causes the prop 31 to swing against the force of the spring 33, and the arm 35 engages the tip 2A as shown in FIG. 2. Thereafter, the two rocker arms 1 and 2 oscillate together until the arm 35 disengages from the tip 2A. As the high speed cam 22 has a larger profile than the low speed cam 21, the sub-rocker arm 2 and main rocker arm 1 that moves together with it follow the motion of the high speed cam 22. This increases the valve lift and valve opening time of the intake valve 9. At the same time, the smaller low speed cam 21 floats away from the cam follower 14 depending on the rotation position.

When the engine again shifts from the high speed region to the low speed region, the pressure in the chamber 37 falls due to the action of the change-over valve, and the prop 31 rotates the arm 35 into the non-engaged position with the tip 2A due to the elastic restoring force of the spring 33 so that there is again free rotation between the main rocker arm 1 and the sub-rocker arm 2. In this state, the main rocker arm 1 again follows the low speed cams 21.

In this operation, if the positions of the through hole 44 of the rocker shaft 3 and the through hole 42 of the main rocker arm 1 are displaced, the flow of pressurized off from the chamber 37 becomes constricted in this part so that the, change-over response of the cams 21 and 22 is impaired. In order to prevent this, axial displacement of the main rocker arm 1 with respect to the rocker shaft 3 must be prevented.

According to this invention, therefore, a thrust fin 51 is provided projecting downwards on the main rocker arm 1, and a guide groove 52 engaging with the thrust fin 51 is provided on the cylinder head 4.

The thrust fin 51 is formed in a one-piece construction with the main rocker arm 1, and projects downwards. The main rocker arm 1 is formed effectively symmetrically on either side of the center of the sub-rocker arm 2, and the thrust fin 51 is formed in a position axially offset from the arm 35, spring 33 and pin 34 beyond the mass center of the arm assembly that is shown by a dotted line in FIG. 4. Due to this arrangement, the mass center of the arm assembly is situated effectively in the middle of the main rocker arm 1.

This arrangement therefore contributes to making the surface pressure acting between a bearing 39 of the main rocker arm 1 and the rocker shaft 3, uniform, and to reducing frictional resistance to the swing of the main rocker arm 1.

Two lateral surfaces 53 of the thrust fin 51 are effectively perpendicular to the central axis of the rocker shaft 3. A pair of walls of a guide groove 52 comprise thrust surfaces 55 on which the fin 51 slides. The thrust load transferred by the fin 51 is thereby supported by the groove 52. The guide groove 52 is formed by cutting the cylinder head 4 with an end mill. The guide groove 52 only accommodates the thrust fin 51, and therefore the width of the groove 52 is much narrower than that of the hollow in the prior art device which accommodates the whole base of the rocker arm. As best seen in FIG. 4, the width of thrust fin 51 is much less than the width of the rocker arm. Both the thrust surfaces 55 may therefore be formed in one operation by using a suitable end mill for the groove width. In this case, the end mill comes into contact with the thrust surfaces 55 on both sides during the operation of cutting the guide groove 52, so the load acting on the end mill perpendicular to the guide groove 52 during cutting constantly acts on the end mill from both sides. Due to this balanced load, the cutting operation is easier than in the case of the conventional example, and good results are therefore obtained with regard to precision of all parameters such as flatness, verticality and position of the thrust surfaces 55.

The aforementioned hole 36 and piston 30 are situated above the guide groove 52. Further, as the guide groove 52 is closed off at both ends, it functions as an oil storage chamber for storing off that has leaked out from the gap between the piston 30 and hole 36. The cylinder head 4 comprises an upper deck 56 inclined toward the center of the cylinder head 4 as shown in FIG. 2 and an oil collection hole, not shown, is formed in this upper deck 56.

Hence, by accumulating leaked off in the guide groove 52, the sliding cooperation between the lateral surfaces 53 of the thrust fin 51 and the thrust surfaces 55 of the guide groove 52 are lubricated, and frictional resistance to the swing of the main rocker arm 1 is greatly reduced. Due to this reduction of frictional resistance and by maintaining the cross-sectional area of the off flowpath, the change-over response between the cams 21 and 22 is always maintained at a desirable level.

Oil that has overflowed from the guide groove 52 is recovered by the collecting hole via the upper deck 56, and recirculated to the off pump via a passage, not shown.

In the above-described construction, the thrust fin 51 is formed continuously with the bearing 57 of the rocker shaft 3 and a bearing 58 of the piston 30, with the result that the thrust fin 51 functions as a rib that increases the rigidity of the rocker arm 1 with respect to the load acting on these bearings. This function is useful when it is desired to make the rocker arm 1 more lightweight.

In the aforesaid example, this invention was applied to the intake valve 9, however it will be understood that it may also be applied to the exhaust valve 10.

Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. An engine valve drive mechanism, comprising:

a rocker shaft fixed to an engine;

a rocker arm having a bearing which is slidably supported on said rocker shaft such that said rocker arm is supported to freely rotate on said rocker shaft;

a valve that opens and closes according to an oscillation of said rocker arm;

cam means that rotates in synchronism with said engine for causing said rocker arm to oscillate;

a thrust fin projecting from said rocker arm in a radial direction with respect to said rocker shaft, a width of said thrust fin being less than a width of said rocker arm; and a guide groove accommodating said thrust fin for preventing said rocker arm from displacing along said rocker shaft.

2. A valve drive mechanism as defined in claim 1 wherein;

said cam means comprises a plurality of cams having different profiles, and said drive mechanism further comprises a cam change-over mechanism for changing over said cams.

3. A valve drive mechanism as defined in claim 2, wherein:

said rocker arm comprises a hydraulic piston for driving said cam change-over mechanism and an oil pressure chamber housing said piston, and said thrust fin is formed below said hydraulic piston.

4. A valve drive mechanism as defined in claim 3, wherein:

said guide groove is closed off at both ends so as to store oil leaked from said pressure chamber.

5. A valve drive mechanism as defined in claim 2, wherein:

said cam change-over mechanism is installed on said rocker arm, and a center of mass of said cam change-over mechanism and a center of mass of said thrust fin are displaced relative to each other along an axial direction of said rocker shaft.

* * * * *